US005429349A

United States Patent [19]

Supron et al.

[11] Patent Number: 5,429,349

[45] Date of Patent: Jul. 4, 1995

[54] APPARATUS FOR BUFFERING TRANSPORT OF DOCUMENT USING CONICAL SCREW CONVEYERS

[75] Inventors: Steven A. Supron, Prospect; Ming Xiao, Terryville, both of Conn.

[73] Assignee: Pitney Bowes Inc., Stamford, Conn.

[21] Appl. No.: 236,813

[22] Filed: May 2, 1994

[51] Int. Cl.[6] ..... B65H 29/42

[52] U.S. Cl. ..... 271/199; 198/163; 414/795.1; 271/184

[58] Field of Search ..... 271/177, 178, 179, 184, 271/185, 225; 414/795.1, 793.9, 794.2; 198/663, 671

[56] References Cited

U.S. PATENT DOCUMENTS

| | | | |
|---|---|---|---|
| 3,280,679 | 10/1966 | Huffman | 271/179 X |
| 4,270,747 | 6/1981 | Templeton | 271/179 |
| 4,547,114 | 10/1985 | Watrous et al. | 271/179 X |

FOREIGN PATENT DOCUMENTS

| | | | |
|---|---|---|---|
| 541896 | 6/1950 | Canada | 271/179 |
| 740838 | 2/1933 | France | 271/179 |
| 0002503 | 1/1980 | Japan | 414/795.1 |
| 0034851 | 2/1989 | Japan | 271/179 |

*Primary Examiner*—David H. Bollinger
*Assistant Examiner*—Carol L. Druzbick
*Attorney, Agent, or Firm*—Robert H. Whisker; Melvin J. Scolnick

[57] ABSTRACT

An apparatus is provided for buffering transport of freshly inked documents. The apparatus has a plurality of opposite, parallel, threaded conical screw conveyers. Each pitch of the screw conveyer creates a drying station for an inked document. As inked documents travel upon the threads of the screw conveyers, the conical shape of the conveyers maintain the document in a substantially central position. A lower deck is provided for receiving inked documents. The buffer apparatus has a pusher mechanism to control document movement from the buffer to a downstream document handler, such as an envelope flapper.

4 Claims, 5 Drawing Sheets

APPARATUS FOR BUFFERING TRANSPORT OF DOCUMENT USING CONICAL SCREW CONVEYERS

BACKGROUND OF THE INVENTION

The present invention relates to a document buffer and more particularly to an apparatus for buffering transport of document coated with liquid ink using conical screw conveyers.

For increasing the throughput of mailing machines, it is important to provide means for buffering transport of inked document exiting a liquid ink printer, such as an ink jet printer, so that the ink is relatively dry upon the document and will not smear. This presents a problem of storing the document during the drying period without leading to stoppages in the operation of the transport and in turn halting operation of the entire mailing system. Heretofore, it has been the practice to extend the path of travel for document to enable sufficient drying time prior to further manipulation of the document. Machines for drying articles, such as printed material, have often consisted of a long, substantially horizontal, conveyor belt on which articles to be dried are placed. A disadvantage of this type of machine is that, since they are longitudinally oriented, extending the path utilizes valuable space and consumes much time.

Recently, the present inventors conceived and developed a buffer apparatus to handle a continuous flow of freshly inked sheets at a high rate. A pending patent application, Ser. No. 08/174,870, filed Dec. 29, 1993, entitled APPARATUS FOR BUFFERING TRANSPORT OF DOCUMENT, assigned to the assignee of the instant patent application, describes the buffer apparatus. Although this arrangement worked satisfactorily, the present inventors found that the belt imparting motion to the screw conveyers caused unwanted movement away from the home position while adjusting the belt tension. In addition, the buffer apparatus required a more robust eject mechanism to control document movement from the buffer station to a document handler, such as an envelope flapper.

SUMMARY OF THE INVENTION

The present invention is intended to obviate or eliminate the disadvantages and problems discussed above. In its broader aspects, the present invention is directed to an apparatus for buffering transport of a document wherein the apparatus is adapted to handle a continuous flow of freshly inked sheets at a high rate. An apparatus having features of the present invention comprises an upper deck oriented at an acute angle with respect to a horizontal plane. The apparatus has a plurality of gears in driving engagement with a plurality of opposite, parallel, threaded conical screw conveyers. As the screw conveyers rotate, the document is transported downwards. A registration surface guides the document into engagement between the upper deck and the screw conveyers. The conical shape of the screw conveyers maintain the document in a substantially central position. The apparatus has a lower deck located beneath the plurality of screw conveyers for receiving the transported document. An eject mechanism then pushes the document horizontally from the apparatus.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENT

Figure 1:
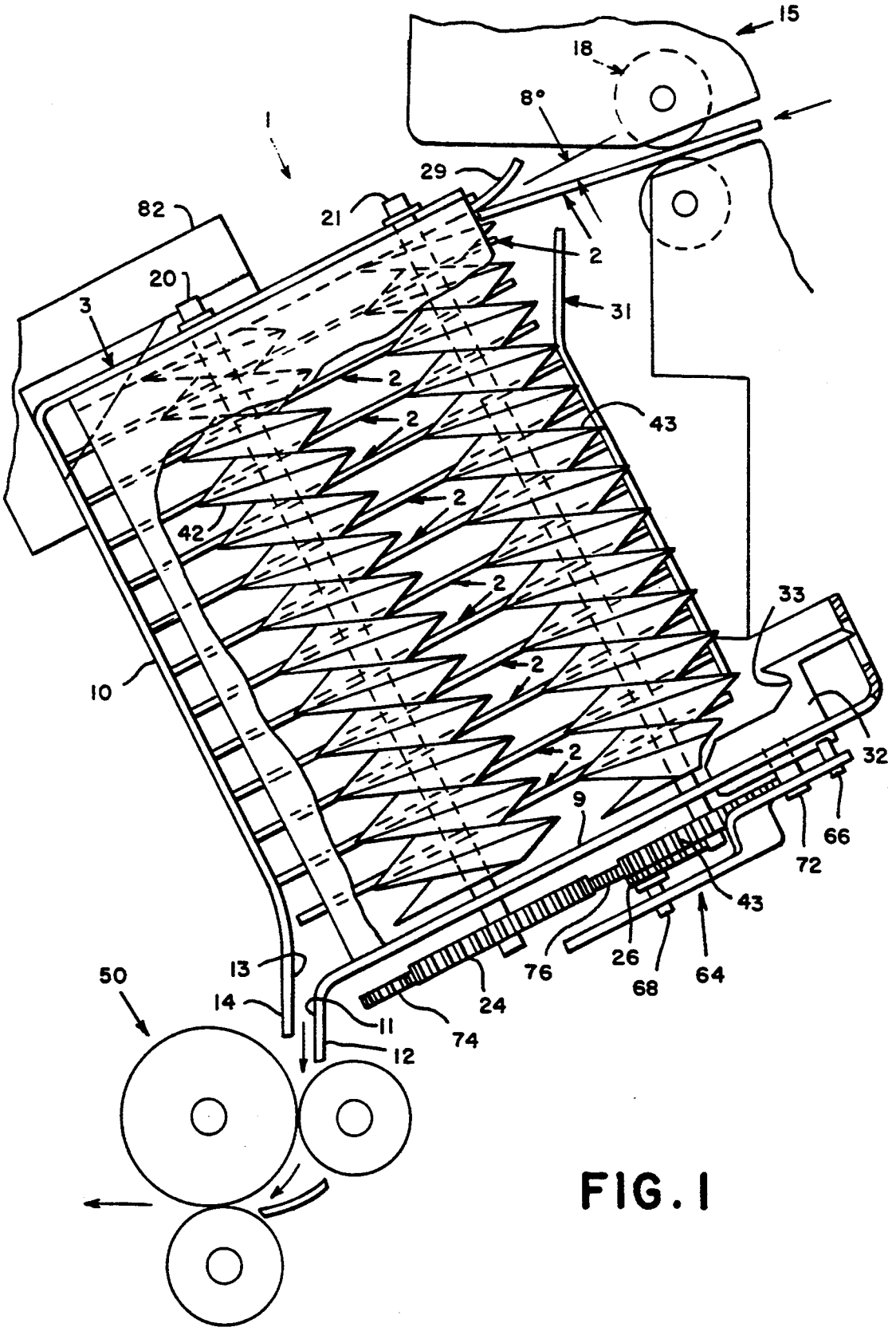
FIG. 1 is a side elevational view of the apparatus.

FIG. 1 shows an apparatus 1 suitable for buffering the transport of a series of document 2, such as those coming from a printer 15. The printer 15 is preferably a conventional, stand-alone device. The printer 15 includes conventional printing structure, such as any conventional thermal, ink jet, or other commercially available printing apparatus. In addition, the printer 15 includes a conventional feeding structure. The feeding structure may be any conventional roller-type structure for engaging and feeding the document 2, including a roller 18 for feeding document 2 from the printer 15.

The apparatus 1 comprises an upper deck 3, oriented at an acute angle with respect to a horizontal plane, a lower deck 9, a door 31, and a rear guide 10. Registration surfaces 29, 30 are fixably mounted to the upper deck 3. The lower deck 9 has a first tail end 12 extending from the lower deck 9. This first tail end 12 forms a lower guiding surface 11 for document 2 exiting the apparatus 1. Door 31 is hingedly connected to the lower deck 9. The door 31 extends across the apparatus 1 interior to prevent an operator from reaching inwardly. Mounted on door 31 is sensor (not shown), which may take the form of a Hall effect sensor, indicating whether door 31 is in a closed position. Rear guide 10 is fixably mounted to the upper deck 3, extending generally perpendicular to and along one side of the upper deck 3. Also, mounted on the rear guide 10 is an entrance sensor 82 to indicate the presence of a document 2 entering the apparatus 1. The rear guide 10 has a second tail end 14 extending from the rear guide 10. This second tail end 14 forms an upper guiding surface 13 for document 2 exiting the apparatus I from printer 15. The apparatus 1 may deliver document 2 into a conventional document handler (not shown) such as an envelope flapper, document folder, or inserter by passing the document 2 between the first tail end 12 and the second tail end 14. The apparatus 1 includes a conventional feeding structure. The feeding structure may be any conventional roller-type structure for engaging and feeding the document 2, including a roller 50 for feeding document 2 into the document handler.

Figure 2:
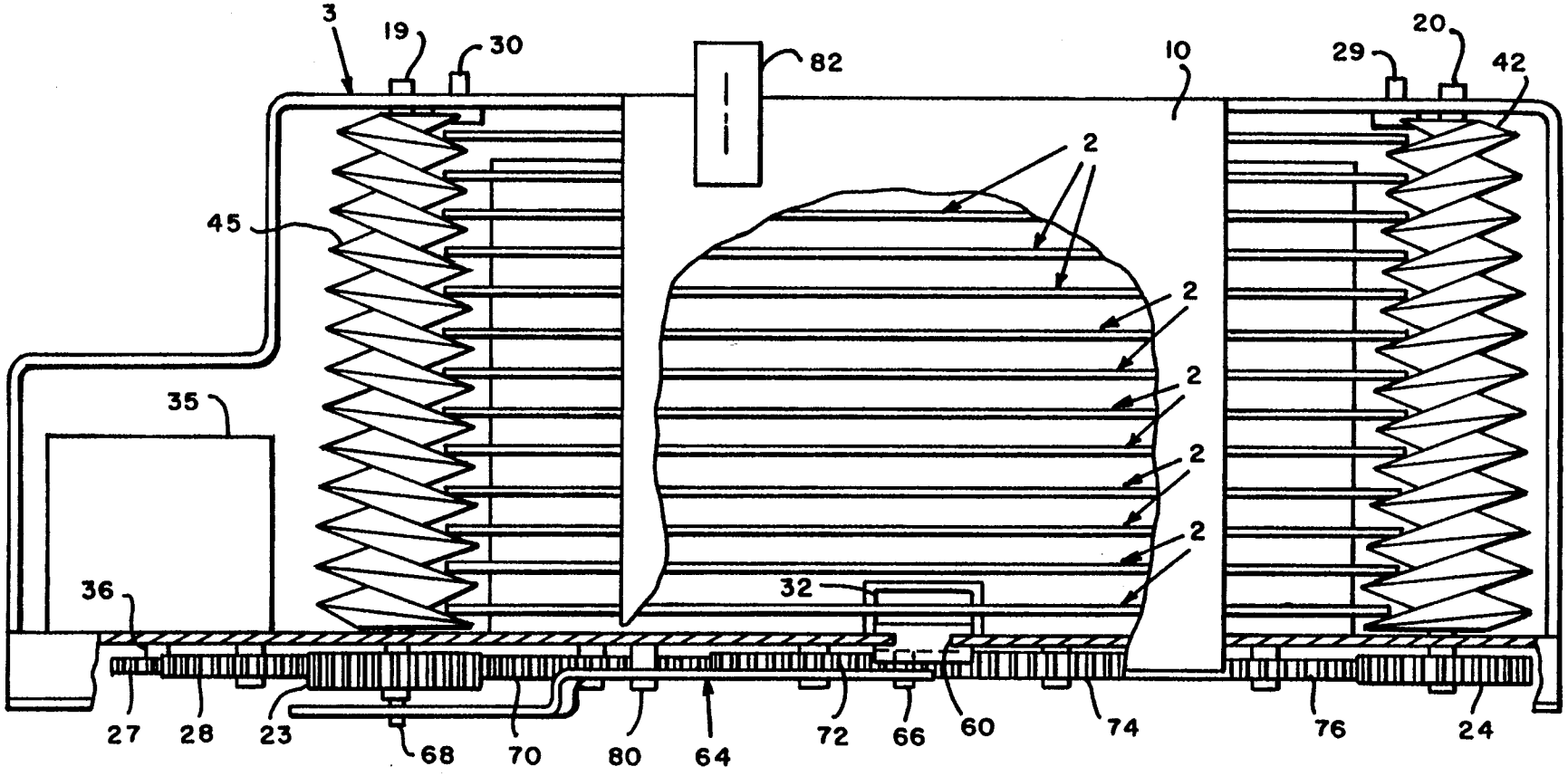
FIG. 2 is a partial front view of the apparatus.
Figure 3:
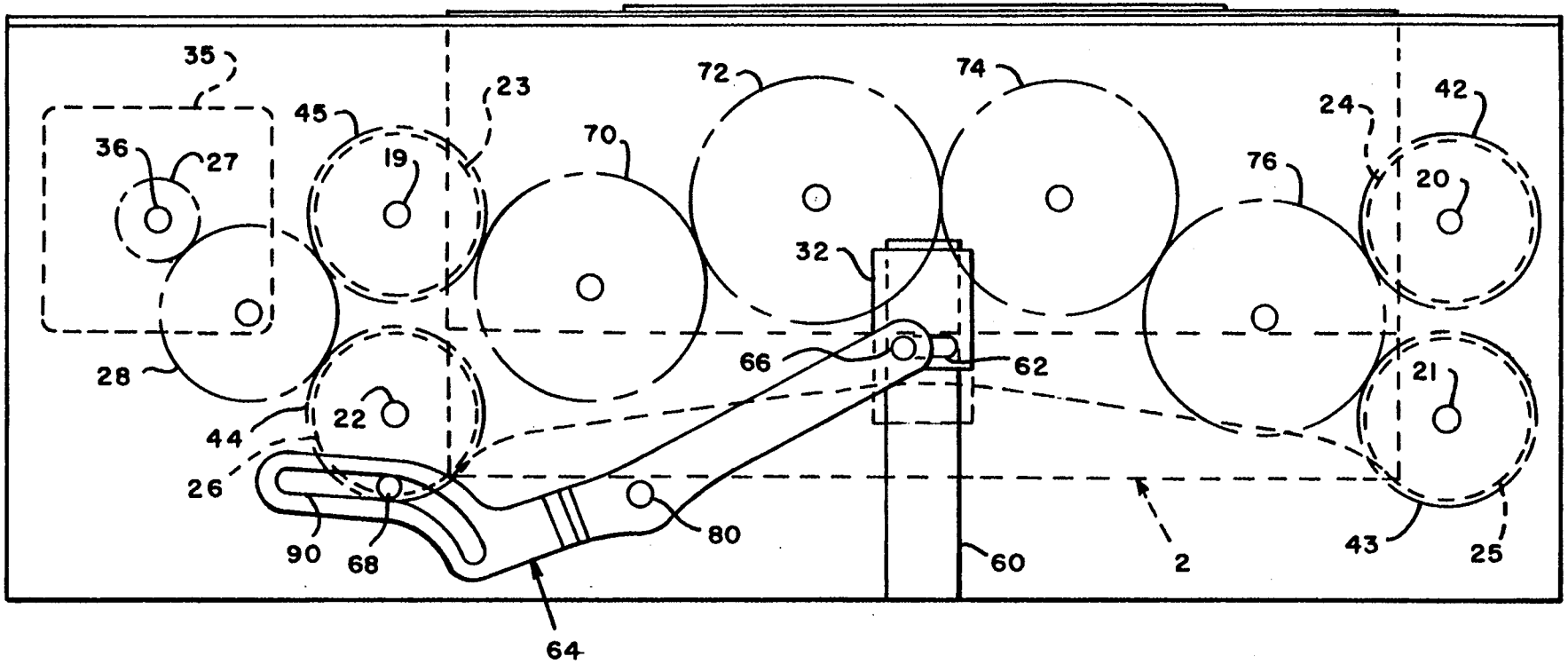
FIG. 3 is a bottom view of the apparatus in the home position.
Figure 4:
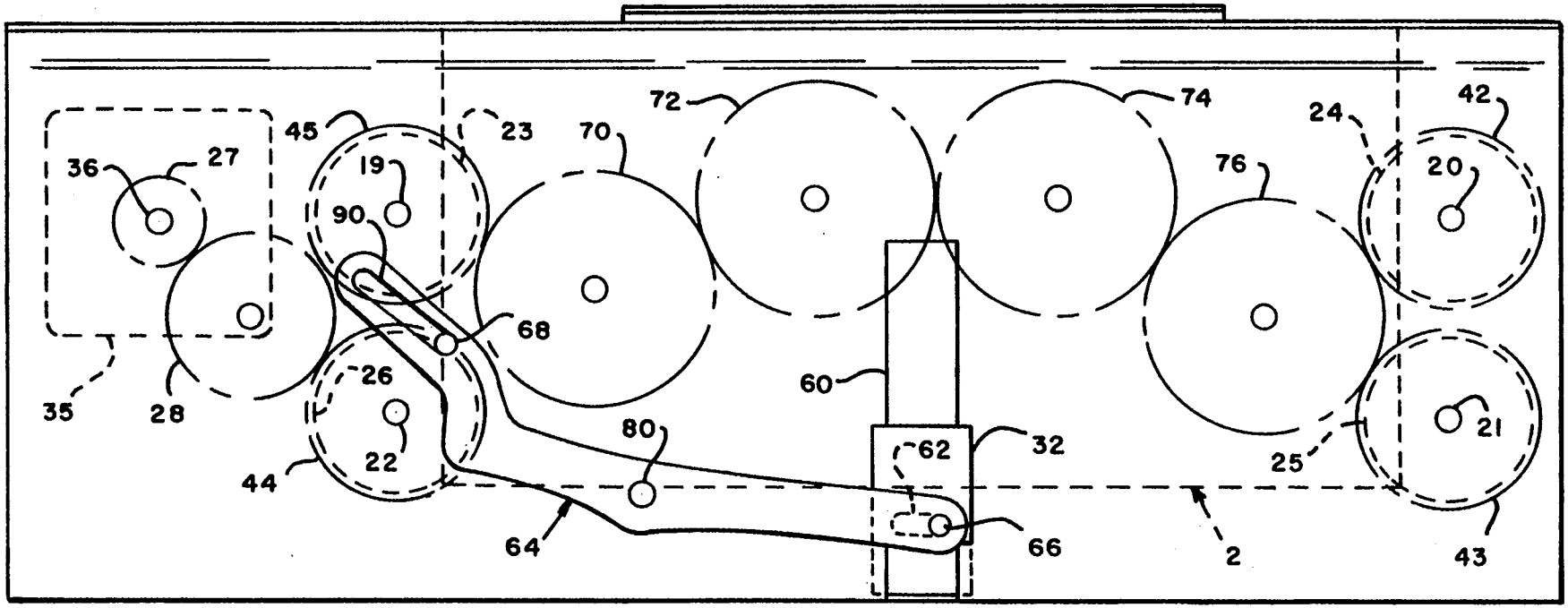
FIG. 4 is a bottom view of the apparatus in the document receiving position.

Referring to FIGS. 2 and 3, a plurality of vertically disposed, opposite, parallel, conical screw conveyers 42 43 44, and 45 are orthogonal to the upper deck 3. The screw conveyers 42, 43, 44, and 45 are mounted apart an appropriate distance to permit the edges or other suitable projection of document 2 to engage in the threads of these conveyers 42, 43, 44, and 45. The conical shape of these conveyers 42, 43, 44, and 45 enable side registration as document 2 travels down the conveyers 42, 43, 44, and 45 to the lower deck 9. The screw conveyers 42, 43, 44, and 45 are threaded to like pitch and oppositely, screw conveyers 42 and 43 being left hand and screw conveyers 44 and 45 being right hand.

The screw conveyers 42, 43, 44, and 45 are fixably mounted onto shafts 19, 20, 21, 22. The shafts 19, 20, 21, and 22 are rotatively mounted at one end to the upper deck 3. At the other end, the shafts 19, 20, 21, and 22 extend through the lower deck 9. Underneath the lower deck 9, gears 23, 24, 25, 26 are fixably mounted onto the shafts 19, 20, 21, and 22. The motor 35 has a shaft 36 on which is mounted a drive gear 27 in drive communication with transmission gear 28. The transmission gear 28 is adapted to mesh with gears 23 and 26 thereby rotating conical screw conveyers 44 and 45. Gears 23 and 26 transmit motion to intermeshed gears 70, 72, 74, and 76. Gear 76 is adapted to mesh with and drive gears 20 and 21 thereby rotating conical screw conveyers 42 and 43.

Figure 5:
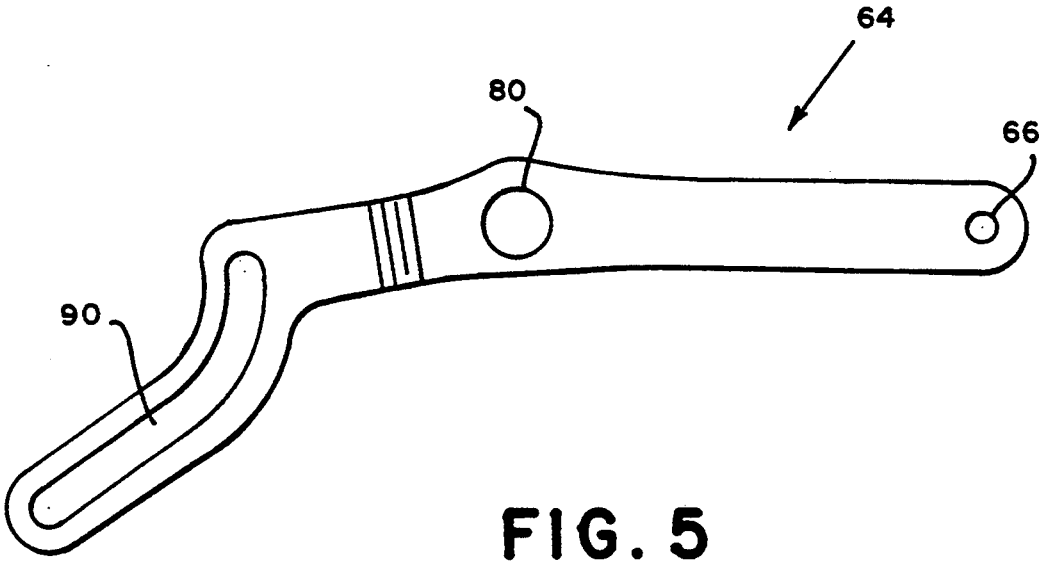
FIG. 5 is an exploded view of the pivotable lever.

As illustrated in FIG. 3, pusher 32 is slidably mounted into channel 60, thereby allowing horizontal movement of the pusher 32 within the channel 60. Referring to FIGS. 3 and 5, pin 66 extends upwards from lever 64 to engage pusher 32. More specifically, pin 66 protrudes through the channel 60 to be received within an elongated opening 62 of the pusher 32. Lever 64 provides a slot-like cut-out 90 through which peg 68, extending from gear 26, projects freely downwards. The cut-out 90 is positioned and shaped so that as gear 26 rotates, the peg 68 travels within cut-out 90 thereby causing the lever 64 to pivot about pivot point 80.

In the embodiment of the invention as illustrated in FIGS. 1 to 4, a printer 15 prints information on document 2 including a mailing address, bar code, or indicia. The printer transports inked document 2 through feed roller 18 lead edge first. The upper deck 3 is oriented at an acute angle with respect to the printer 15 horizontal, preferably an approximate twenty degree angle. To overcome the natural curling action of document 2 under the influence of the atmosphere, the document 2 may be fed into the registration surfaces 29, 30 at an approximate eight degree angle. This feeding action bends the document 2 thereby flattening the lead edge. The registration surfaces 29, 30 ensure that the document 2 falls between the pitch of conveyers 42, 43, 44, and 45. Each pitch of screw conveyers 42, 43, 44, and 45 creates a drying station for inked document 2. In the preferred embodiment, there are twelve pitches per screw conveyer 42, 43, 44, and 45 having an approximate allotted drying time of four seconds per document. The drying time may be increased or decreased by changing the software parameters controlling the number of conveyer revolutions per second.

Roller 18 feeds the document 2 until the entrance sensor 82 detects the lead edge. At that time, the lead edge abuts rear guide 10 and rests on screw conveyers 42 and 45 while the trail edge rests on screw conveyers 43 and 44. After the entrance sensor 82 detects the lead edge, the motor 35 rotates thereby imparting motion to the screw conveyers 42, 43, 44, and 45. As the screw conveyers 42, 43, 44, and 45 rotate, the conical shaped conveyers 42, 43, 44, and 45 center the document 2 traveling downward along the threads.

Figure 6:
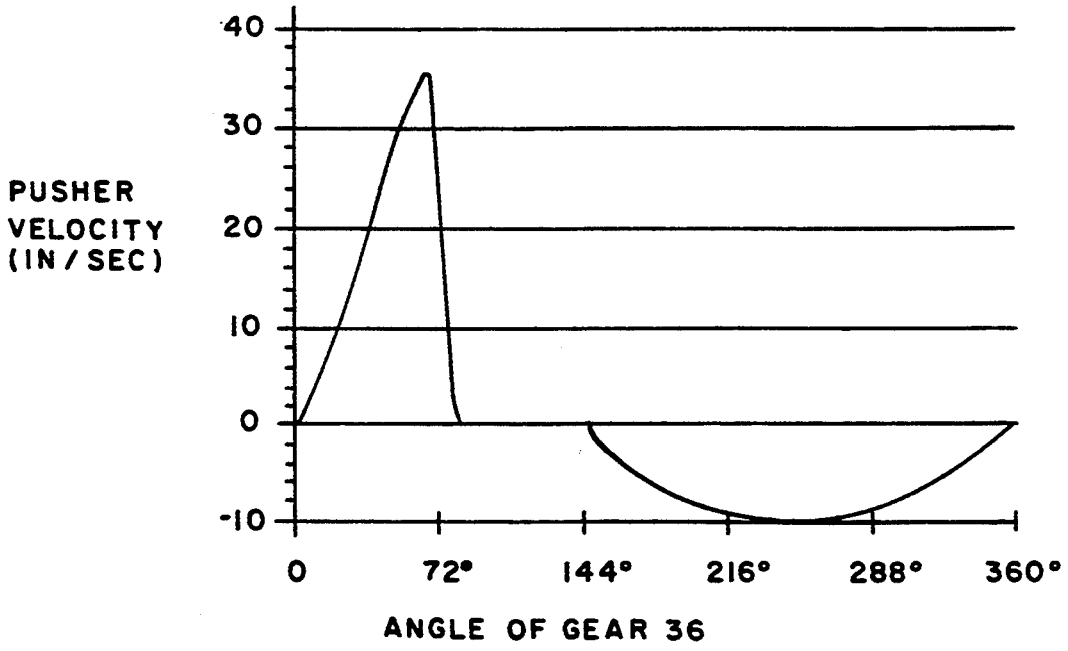
FIG. 6 graphically represents movement of the pusher.

FIG. 3 illustrates the apparatus 1 in the home position. In this position, the lowest drying station is empty and ready to receive document 2. A Hall effect sensor (not shown) determines the location of home position by detecting the presence of a magnet embedded in gear 26 which indicates that conveyer 44 is in the home position. Pusher 32 rests in a full forward position within the channel 60. The activity of the pusher 32 is shown graphically in FIG. 6. The abscissa represents the angle of gear 26 relative to its home position and the ordinate indicates the pusher velocity. Pusher 32 dwells during the first 2.5° of rotation from the home position. At 2.5°, lever 64 drives pusher towards the rear of channel 60. At 72°, the pusher 32 reaches the eject position, approximately 0.5" past the trailing edge of document 2 (see FIG. 4). The pusher 32 will stay in such eject position between 72° and 144°. When gear 26 has rotated to the point where it is 144° from the home position, document 2 enters the lowest drying station, and lever 64 drives pusher 32 forward within channel 60. At 200°, the pusher 32 will engage document 2 to perform the ejecting operation. Between 200° and 357.5°, pusher 32 drives document 2 across the lower deck 9, between the upper guiding surface 13 of the rear guide 10 and the lower guiding surface 11 of the lower deck 9. These guiding surfaces 11, 13 redirect document 2 from an approximate 20° with respect to the printer horizontal to 90°. At 357.5°, gear 26 will reach home position. Thereafter, document 2 is held pressured into the nip of roller 50. Pusher 32 will impose sufficient force to eject the document 2 from the apparatus 1. To maintain control of document 2 during ejection, pusher 32 has a lip 33 which abuts the transverse edge of document 2 ensuring that the transverse edge will not rise over the pusher 32 thereby impairing ejection of the document 2 from the apparatus 1. Once the trail edge of document 2 enters the nip of roller 50, the apparatus 1 is ready to receive the next document 2 from printer 15.

This and other variations and modifications, as will be evident to those skilled in this art, may be made therein without departing from the spirit of the invention, and the invention as set forth in the appended claims is thus not to be limited to the precise details of construction set forth above as such variation and modifications are intended to be included within the scope of the appended claims.

What is claimed is:

1. An improved apparatus for buffering transport of a document of the type in which an upper deck is orthogonal to a plurality of opposite, parallel, threaded screw conveyers, the document is transported down the screw conveyers, and a lower deck is positioned beneath the plurality of screw conveyers for receiving the document, wherein the improvement comprises:

(a) gear means for rotating the plurality of screw conveyers, and (b) means for moving the document horizontally from the apparatus along the lower deck, the moving means including a pusher block, a pin mounted onto a gear, and a pivotable lever having an opening with contoured surfaces operatively connected to the pusher block.

2. An apparatus as set forth in claim 1 wherein the lower deck includes a first tail end extending frown the lower deck thereby forming a lower guiding surface.

3. An apparatus as set forth in claim 2 further comprising a rear guide for lead edge registering the document, the rear guide fixably mounted to the apparatus, extending generally perpendicular to and along one side of the upper deck.

4. An apparatus as set forth in claim 3 wherein the rear guide includes a second tail end extending from the rear guide thereby forming an upper guiding surface.

* * * * *